US010845746B2

(12) United States Patent
Haik et al.

(10) Patent No.: US 10,845,746 B2
(45) Date of Patent: Nov. 24, 2020

(54) IDENTIFYING LINEAR DEFECTS

(71) Applicant: HP Indigo B.V., Amstelveen (NL)

(72) Inventors: Oren Haik, Ness Ziona (IL); Oded Perry, Ness Ziona (IL); Avi Malki, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/345,784

(22) PCT Filed: Jan. 20, 2017

(86) PCT No.: PCT/EP2017/051197
§ 371 (c)(1),
(2) Date: Apr. 29, 2019

(87) PCT Pub. No.: WO2018/133945
PCT Pub. Date: Jul. 26, 2018

(65) Prior Publication Data
US 2019/0377296 A1 Dec. 12, 2019

(51) Int. Cl.
*G03G 15/00* (2006.01)
*B41J 11/00* (2006.01)

(52) U.S. Cl.
CPC ..... *G03G 15/55* (2013.01); *B41J 11/009* (2013.01); *G03G 15/5016* (2013.01); *G03G 15/5062* (2013.01)

(58) Field of Classification Search
CPC ..... G03G 15/55; G03G 15/5016; G03G 15/5062; B41J 11/009; H04N 5/3675; G06T 5/005; G01N 21/896
See application file for complete search history.

(56) References Cited

U.S. PATENT DOCUMENTS

| | | | | |
|---|---|---|---|---|
| 6,398,334 | B2 | 6/2002 | Dunand | |
| 6,812,997 | B2 | 11/2004 | Kaltenback et al. | |
| 2005/0147286 | A1* | 7/2005 | Lee | G01N 21/8986 382/141 |
| 2006/0204127 | A1* | 9/2006 | Muammar | G06T 5/005 382/274 |
| 2009/0274342 | A1* | 11/2009 | Wu | B41J 29/393 382/112 |
| 2012/0216689 | A1 | 8/2012 | Cochran et al. | |
| 2013/0010175 | A1* | 1/2013 | Pichon | G01N 21/896 348/335 |

(Continued)

FOREIGN PATENT DOCUMENTS

| | | | | |
|---|---|---|---|---|
| JP | 2008221625 | * | 3/2007 | H04N 1/23 |
| JP | 2008221625 | | 9/2008 | |
| JP | 2015155162 | | 8/2015 | |

OTHER PUBLICATIONS

Machine translation of JP2008221625 (Year: 2007).*

(Continued)

*Primary Examiner* — Iriana Cruz
(74) *Attorney, Agent, or Firm* — Dicke Billig & Czaja PLLC

(57) ABSTRACT

In an example, a method includes determining, by a processor, a cumulative indication of defects present in linear sub-portions located in a common position of each of a plurality of substrate sheets bearing a printed image. The method may further comprise identifying, by the processor, a linear defect based on the cumulative indication of defects.

18 Claims, 4 Drawing Sheets

(56) References Cited

U.S. PATENT DOCUMENTS

| | | | | |
|---|---|---|---|---|
| 2013/0087059 | A1 | 4/2013 | Baird et al. | |
| 2014/0348550 | A1* | 11/2014 | Nagayama | G03G 15/0877 399/262 |
| 2015/0110505 | A1* | 4/2015 | Takahashi | G03G 15/5062 399/15 |
| 2017/0104940 | A1* | 4/2017 | Tsukuda | H04N 5/3675 |

OTHER PUBLICATIONS

Vans, M et al, Jun. 21, 2010, Automatic Visual Inspection and Defect Detection on Variable Data Prints21-Jun-2010, < http://www.hpl.hp.com/techreports/2008/HPL-2008-163R1.pdf >.

* cited by examiner

IDENTIFYING LINEAR DEFECTS

BACKGROUND

In printing, print agents such as inks, toners, coatings and the like (generally, 'print agents') may be applied to a substrates. Substrates may in principle comprise any material, for example comprising paper, card, plastics, fabrics or the like.

In some examples, the resulting print may be analysed in order to identify potential or actual defects. In some examples, a printed substrate is scanned, and the captured image is compared to a reference image, for example an image which formed the basis of a print instruction, or previously printed image which has been determined to meet certain criteria.

Defects can for example arise from print agents being transferred first to, and then to the substrate from, a component of the print apparatus, and/or from a failure to transfer print agents correctly, or the like.

BRIEF DESCRIPTION OF DRAWINGS

Non-limiting examples will now be described with reference to the accompanying drawings, in which.

DETAILED DESCRIPTION

A printed image may be analysed to detect defects therein. There are many potential sources of defects in an image, for example aging or failing print apparatus components, damaged or inappropriate substrates or coatings, inappropriate ink (or other print agent) compositions, a need to clean the apparatus, and the like. Thus, even if a user is made aware of a defect, it may not be clear what an appropriate remedial action is, or whether the defect is a result of transient conditions and will resolve itself.

This can lead to wasted time in determining the source of a defect and, in the event of mis-diagnosis of the fault, inappropriate and potentially expensive maintenance operations.

Figure 1:
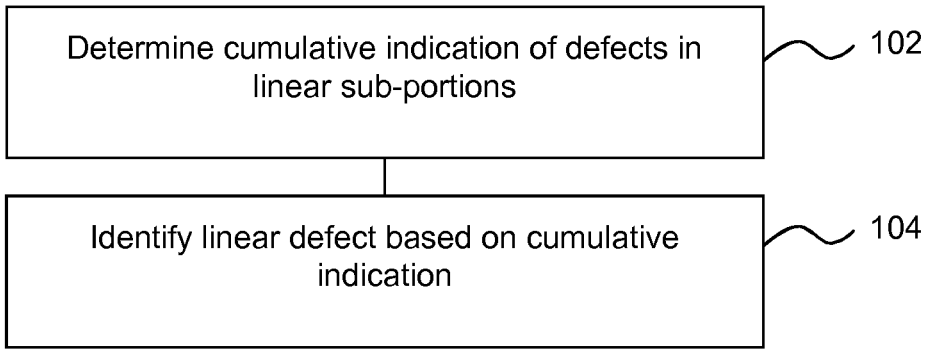
FIG. 1 is a flowchart of an example method of identifying linear defects.

FIG. 1 is an example of a method, which may be a method of detecting or identifying a linear defect within a printed image on a substrate sheet, and which may be a computer implemented method. As is further described below, a linear defect may be any defect which extends across a sheet, for example in a substantially line-like or bar-like manner and/or a defect which occupies a threshold amount of a linear sub-portion of a sheet.

Block 102 comprises determining, by the processor and based on a plurality of scanned images of substrate sheets, a cumulative indication of defects present in a linear sub-portion located in a common position of each substrate sheet.

For example the defects may be determined from a plurality of scanned images, each scanned image being a scanned image of a printed substrate sheet bearing a printed image. For example, the scanned images may be images of a plurality of printed pages. The image may for example be acquired by scanning apparatus, which may be operatively connected to the processor. In some examples, the processor may comprise a component of print apparatus or scanning apparatus (and some apparatus for printing images may incorporate both print apparatus and scanning apparatus). In other examples, the scanned image may be acquired from a memory, which may be local or remote, and/or maybe received over a network, or the like.

In some examples of the method, scanned images may be analysed, and in each of the scanned images, a linear sub-portion located in a common position of each substrate sheet to identify any defects therein. In some examples, the linear sub-portion may comprise a vertical or horizontal (or an otherwise oriented) strip or bar on the sheet. In some examples, the linear sub-portion may extend substantially from one edge of the print image to an opposing edge (e.g. 'top to bottom' or 'side to side'). The width of each linear sub-portion may be predetermined. In some examples, the width is effectively a line at the resolution of the scanning apparatus used to acquire the scanned image, or at the resolution of the print apparatus used to print the image. For example, a scanning apparatus may have a resolution in the order of 60 dots per inch (dpi), in which case the width of a linear sub-portion may be $1/60^{th}$ of an inch. However, in other examples, the linear portion may be wider, for example comprising a plurality of scan lines.

Thus, in some examples, a linear portion of given width (which may in some examples be a 'line') in the same location on each printed substrate sheet may be considered to identify the defects therein. Purely by way of examples, this linear portion may be parallel to the bottom of a sheet and 3 cm therefrom, or may be parallel to the edge of the sheet and 8 cm from the left hand edge, or in some other location on the printed substrate sheet.

Analysing the linear sub-portion may be carried out as part of analysing a larger portion of the sheet, for example, in the formation of at least one 'defect map', as is discussed in greater detail below. In some examples, analysing the linear sub-portion may be carried out in a number of stages, interspersed with analysis of other image sub-portions.

The analysis may comprise comparing the scanned image to reference image data, for example on a pixel-by-pixel, or patch-by-patch, basis. The reference image data may for example comprise the image data used to determine print instructions to print the printed substrate sheet, or may be based on a previously printed image (which may for example have been reviewed and determined to be satisfactory). In other examples, the analysis may be carried out according to some other predetermined criteria, such as an intended mattness of the image, or color consistency, or the like.

The analysis may be a binary analysis: a defect is either determined to be present or absent. In other examples, a degree of deficiency may be evaluated, i.e. a measure of the difference between the printed image and the intended image. In some examples, a certainty level may be assigned, i.e. there is an x % probability that an image pixel/patch has not printed as intended, in which case a higher value may indicate a higher defect probability. This allows for some uncertainty to be introduced to reflect that, for example, the apparent defect may be an error in image capture rather than in printing.

The method of FIG. 1 may therefore comprise, in some examples, determining a value indicative of a printing deficiency at each of a plurality of locations (for example, each of a plurality of scanning pixels) over a plurality printed substrate sheets and combining the values associated with locations in the linear sub-portions of the plurality of printed substrate sheets. In some examples, this may comprise combining a plurality of linear sub-portions, each being in the same position on different sheets, and then determining an overall value for the 'stack' of sub-portions (which may be sub-portion of a stack of defect maps). In such examples, defect values (which may be binary or weighted by the degree of deficiency or certainty associated therewith) may be determined for each of a plurality of pixels, and the values for corresponding pixels for each sheet accumulated before the accumulated values for all pixels in the sub-portion are aggregated. In some examples, this may comprise the determining an overall value for each sub-portion (e.g. counting the number of scanned pixels within the sub-portion which contain a defect, in some example weighted by the degree or certainty associated therewith) and combining the value for the corresponding sub-portions of a number of sheets.

In some examples, the images of scanned pages and/or the location and/or evaluation of the defects may be predetermined and provided to the processor.

Block 104 comprises identifying a linear defect based on the cumulative indication. In some examples, this may comprise comparing the cumulative indication of defects to a threshold and the method further comprises generating, by the processor, an alert indicative of the linear defect.

As the sub-portions are linear sub-portions, a linear defect having the same longitudinal axis as the sub-portions and which is positioned within or encompasses the sub-portion will be highlighted in such a process. Moreover, as the method comprises combining a number of linear sub-portions from corresponding positions on a plurality of printed substrate sheets, recurring linear defects will be highlighted.

There is a class of linear defect which may be referred to as a 'frame mark'. This defect may be seen where a smaller substrate has been printed using a particular print apparatus which is later used for printing a larger substrate. The defect may for example arise as some print agent (for example, ink, toner, or the like) may build up on an image receiving surface of the print apparatus and/or as a result of an impression in the image receiving surface formed by the smaller substrate. In examples where an intermediate transfer member is used (which may for example be rubber endless belt, which may be referred to as a 'blanket' or image transfer member), the intermediate transfer member may be the source of such a defect. In some examples, the intermediate transfer member, as well as transferring an image, acts as a shock absorber and pressure pad, promoting a good print agent transfer to the substrate. Such components may have a finite life span, and may be replaced when damaged or when failing to transfer an image correctly. Correctly diagnosing intermediate transfer member failures can reduce time, complexity and cost of repair.

Such 'frame mark' defects may be hard to detect in the printed image as the optical difference between a printed and an intended pixel or patch may be small. However, the human eye is sensitive to stripes across an image and thus even a small difference may be readily detected by a viewer if it forms a stripe. In the method described above, a plurality of images are considered in detecting the linear defect: this means that even faint linear defects may be detected if, as may the case with frame marks, the defect appears in the same location in a plurality of successive prints. In the case of frame marks, the location is generally parallel to an edge of the previously printed smaller printed substrate sheet, and within around 0-4 mm of that edge.

If a user could reliably identify a defect as arising from an intermediate transfer member, this could be resolved for example by replacing the intermediate transfer member, and may thereby avoid 'trial and error' servicing. Therefore, identifying specifically linear defects may allow diagnosis of the remedial action to be carried out. Accurate diagnosis of a defect generally allows for quicker repair and therefore higher print apparatus utilisation.

Thus the method may comprise identifying a deficiency in an image receiving surface based on the presence of a linear defect (and, in some examples, a position of the linear defect on the printed substrate sheet and/or a width of a region of the printed substrate sheet comprising a linear defect). An image receiving surface may comprise, for example, a photoconductor or an intermediate transfer member within a print apparatus, or any other surface on which an image may be formed prior to being transferred to a substrate.

In some examples, the method of FIG. 1 may be carried out 'on-the-fly', i.e. during a print run, to provide an operator with information about the print operation while it is on-going.

Figure 2:
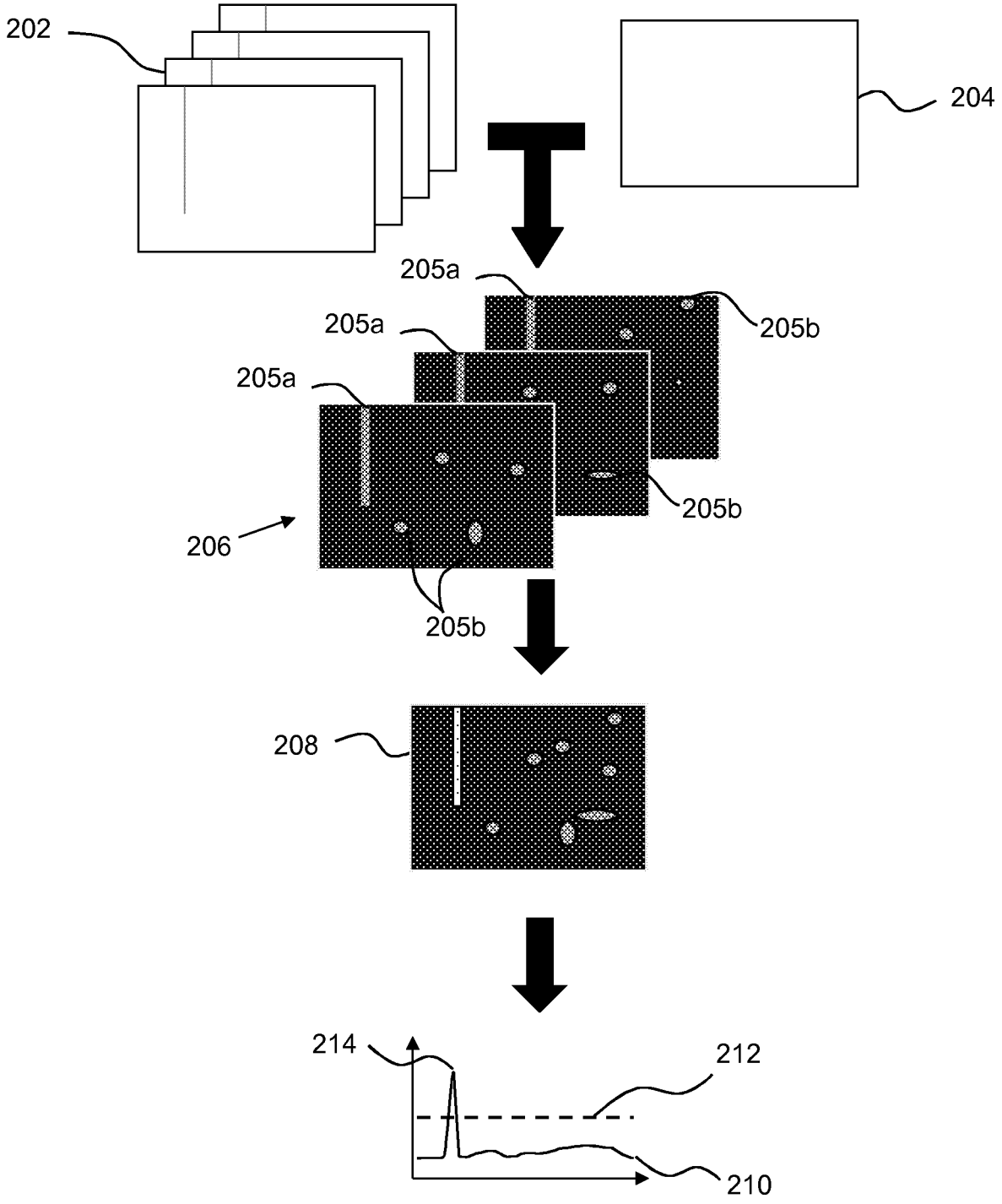
FIG. 2 a schematic representation of an example method of identifying linear defects.

FIG. 2 shows a schematic example of a method which may comprise the method described in relation to FIG. 1. A plurality of sheets 202 are printed, and each is compared to common reference image 204. Although in this case a common reference image 204 is used, the sheets could be printed according to different print instructions and bear different images, in which case the reference image would differ according to the print instructions.

A plurality of defect maps 206 are produced as a result of the comparison. The defect maps represent, for each xy location in the xy plane of the sheet, a value giving an indication of a detected degree of a deficiency in printing. This is indicated in grey scale, with lighter image portions being indicative of a more severe defect, or of a higher probability of a defect (i.e. a larger distinction between the intended and printed image at this point). In this example, each sheet has a linear defect 205*a* and a number of other defects 205*b* (not all of which are labelled).

A composite defect map 208 is produced as a pixel-wise sum of the plurality of defect maps 206. In this example, the linear defect 205*a* which appears in the same position in each of the defect maps is emphasised (lighter in color) in relation to the other defects 205*b*, which occur in different locations with the different defect maps In this example, vertical linear sub-portions are considered, and the values from the sub-portions (in this example, a scanner line within each defect map 206) are summed: in effect, each 2D line forming a sub-portion is projected into a 1D point and used to derive a one dimensional defect graph 210, to which a threshold 212 is applied. The threshold 212 may be predetermined, or may be based on an analysis of the data (for example, a distance from the average value, which may be based on a standard deviation, or the like). In some examples, the threshold may be empirically determined to provide a high detection rate with a relatively low false alarm rate. In some examples, user feedback may be used to alter the threshold, for example in response to an indication of false alarms or missed detections.

In some examples, a maximum 214 in the combined accumulated defect values may be determined and, based on the linear sub-portion providing said maximum, the location of a linear defect on the printed substrate may be identified.

In some examples, any value above the threshold may be determined to be indicative of a linear defect. In some examples, the position of the linear defect may be considered to determine if it is likely to be a 'frame mark' as a result of having previously printed with a smaller substrate. For example, the size of a previously printed smaller substrate may be known and used to determine the range of locations in which a 'frame mark' is likely to be seen. In some examples, just those linear defects which have a position which is within this range of locations may be classified as 'frame mark' linear defects, which may for example, (depending on the print apparatus) suggest that the intermediate transfer member should be considered for servicing or replacement.

Other attributes of the linear mark may also be considered, such as the width of a region of the printed substrate sheet comprising a linear defect. For example, in some print apparatus, a 'frame mark' linear defect may be up to a particular value, for example 2 mm-4 mm, in width. The width may for example be determined by the width of a peak which exceeds the threshold, or the number of adjacent or near adjacent sub-portions in which a linear defect is detected. Other characteristics of a 'frame mark' defect are its consistent placement and linearity, which are exploited in the proposed methods of detection.

Figure 3:
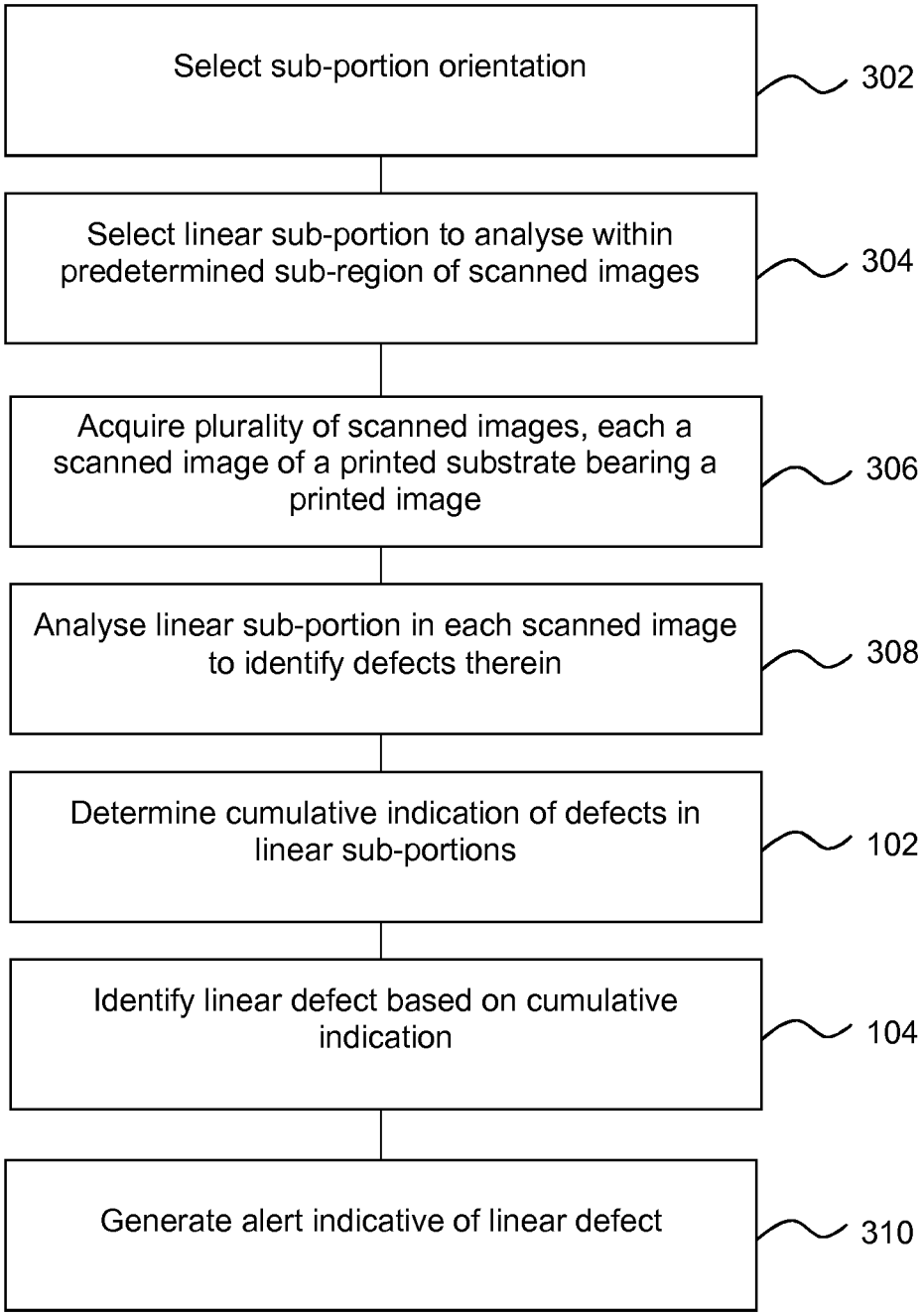
FIG. 3 is a flowchart of another example method of identifying linear defects.

FIG. 3 is an example of a method in which information about the previously printed sheet size is used to determine which image portions are assessed for 'frame mark' linear defects. By decreasing the region of the sheet which is considered, processing resources and/or false alarm rates may be reduced. The method may be a computer implemented method.

Block 302 comprises selecting (for example, by a processor) a linear sub-portion orientation. The selected sub-portion orientation may at least partially define the linear sub-portion to analyse. Print apparatus may be configured to print rectangular sheets. This may be the case even where the printed article is not rectangular: irregular shapes may be cut from rectangular sheets after printing. Therefore, for example, block 302 may comprise a selection of at least one orientation which is parallel to a sheet edge, which may be a previously printed sheet edge. By considering just those linear sub-portions which have an orientation which is are parallel to an edge, all diagonal linear sub-portions may be ignored, for example.

Block 304 comprises selecting a linear sub-portion to analyse which is within a predetermined sub-region of the scanned image, in this example, the sub-region being determined based on the dimensions of a previously printed substrate sheet. The sub-region may therefore comprise a window, and consideration of sub-portions may comprise consideration of sub-portions which are within the window, and not those outside it. For example, the sub-region may comprise a region extending from an edge of the previously printed substrate for around 5 mm, 10 mm, or some other distance. This could be each edge of the substrate (or each edge which is not aligned in terms of the print position with a larger sheet: for example a leading edge may be positioned in the same way within a print apparatus regardless of the sheet dimension). In some examples, it may be the case that frame marks are more likely to occur at the trailing edge of a sheet, and therefore the selected sub-region may be in the region of the trailing edge, and less likely to occur (if at all) at the leading edge.

The selection of block 304 may be a selection of the sub-portions having the orientation selected in block 302, which are also within the sub-region.

Block 306 comprises acquiring (for example, at the processor) a plurality of scanned images, each scanned image being a scanned image of a printed substrate sheet bearing a printed image. For example, the scanned images may be images of a plurality of printed pages. The images may for example be acquired by scanning apparatus, acquired from a memory, which may be local or remote, and/or maybe received over a network, or the like.

Block 308 comprises analysing, by the processor, and in each of the scanned images, a linear sub-portion located in a common position of each substrate sheet to identify any defects therein. As noted above, the linear sub-portion may for example comprise a vertical or horizontal strip on the sheet, and/or may extend substantially from one edge of the print image to an opposing edge. The width of each linear sub-portion may be predetermined, for example based on the resolution of the scanning apparatus used to acquire the scanned image, at the resolution of the print apparatus used to print the image.

As noted above, analysing the linear sub-portion may be carried out as part of analysing a larger portion of the sheet, for example, in the formation of a 'defect map'. The analysis may be a binary analysis, or may evaluate a degree of or probability of a deficiency.

The method then follows with blocks 102 to 104 as outlined above.

In this example, the method continues in block 310 by generating, by the processor, an alert indicative of the linear defect. Generating the alert may comprise generating any form of an alert, for example changing the display of a screen, sounding an alarm, or the like. In some examples, the indication will comprise an indication of a remedial action, for example, indicate that servicing of an image receiving surface within a print apparatus is advised. In some examples, the method may be carried out during a print run, and the print run may be interrupted.

In some examples, the alert may be generated following a verification procedure. In verification, a check may be carried out to determine if the linear defect is in fact a scanner artefact, and/or if a mis-registration has occurred. For example, in the case of real 'frame mark' linear defects, the location of the defect on the printed sheet does not change when printing plurality of images. In contrast, the scanner artefacts may change location on the printed sheet when printing plurality of images (for example because each sheet is not scanned exactly at the same spatial location (variability in paper transfer mechanism). Thus, it may be checked that an indication of the linear is provided over a plurality of sheets (rather than being, for example, a single scanner or print defect having a greater detectability than an individual frame mark). In some such examples, an alert may be generated following successful verification that there is not another likely source of the linear defect, and not otherwise.

In this example, the actual size of a previously printed sheet is considered. In another example, the range of sheet sizes which are compatible with the print apparatus may be considered, regardless of which have previously been printed and a region which borders any such sheet may be selected as possibly containing a linear sub-portion of interest.

Figure 4:
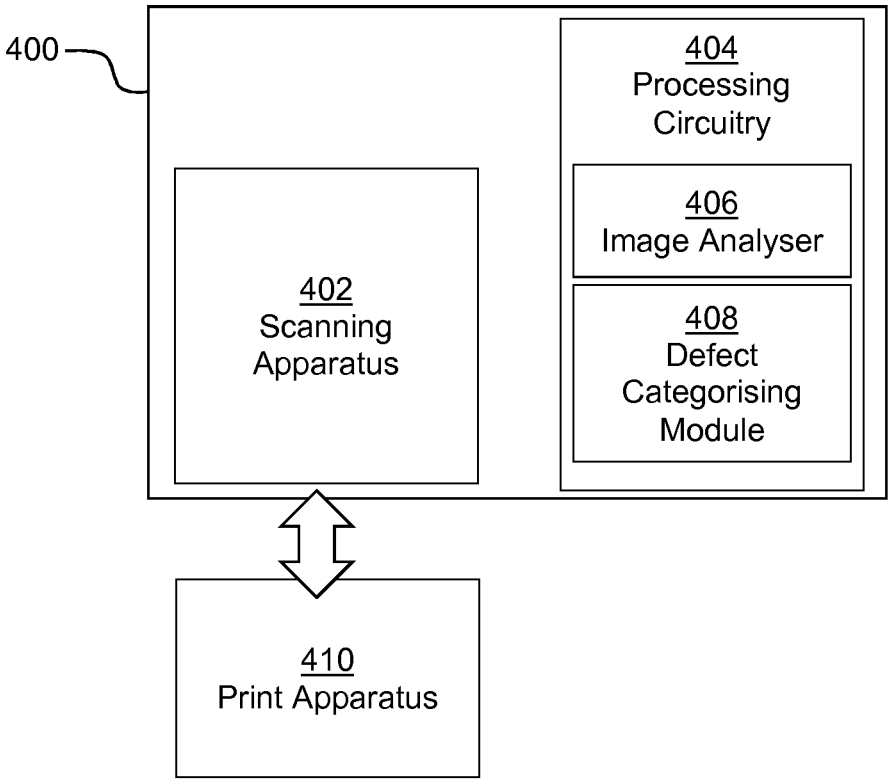
FIG. 4 is a diagram of example apparatus.

FIG. 4 is an example of an apparatus 400 comprising a scanning apparatus 402 to scan a printed image and processing circuitry 404.

The scanning apparatus 402 may be any scanning apparatus suited to the purpose of capturing images of printed pages. In some examples, the scanning apparatus 408 is selected or configured to have an image capture rate which is at least close to, or matched to, the print output frequency of a print apparatus producing the prints analysed thereby.

The processing circuitry 404 comprises an image analyser 406 to identify defects in a printed image and a defect categorising module 408 to accumulate an indication of any defects in each of a plurality of corresponding linear sub-portions of a plurality of printed images.

In some examples, the image analyser 406 is to determine, for each of plurality of printed images, a defect map indicative of the locations of defects within each printed image. In some examples, the defect categorising module 408 is to 'stack' (i.e. combine) at least the regions of the plurality of defect maps comprising the corresponding linear sub-portion of each printed image to accumulate the defects, and to generate a value indicative of a summation of defects in the corresponding linear sub-portions.

In some examples, the defect categorising module 408 is to categorise a defect as an image transfer member defect when the value exceeds a threshold. In some examples, the defect categorising module 408 is to categorise a defect as an image transfer member defect when the value exceeds a threshold and the corresponding linear sub-portions are within a predetermined region of the printed image.

In this example, the apparatus 400 is operatively associated with a print apparatus 410. In some examples, the apparatus 400 may be an integrated apparatus, i.e. the scanning apparatus 402 may be provided at an output of a print apparatus 410, and be integral thereto (for example being mechanically fastened to and/or aligned therewith). However the print apparatus 410, scanning apparatus 402 and processing circuitry 404 could be remote from one another.

In some examples, the print apparatus 410 is a Liquid Electro Photographic (LEP) printing apparatus which may be used to print a print agent such as an electrostatic ink composition (or more generally, an electronic ink). A photo charging unit may deposit a substantially uniform static charge on a photoconductor, for example is a photo imaging plate, or 'PIP' and a write head dissipates the static charges in selected portions of the image area on the PIP to leave a latent electrostatic image over a number of scan operations, or sweeps. The latent electrostatic image is an electrostatic charge pattern representing the pattern to be printed. The electrostatic ink composition is then transferred to the PIP from a print agent source, which may comprise a Binary Ink Developer (BID) unit, and which may present a substantially uniform film of the print agent to the PIP. A resin component of the print agent may be electrically charged by virtue of an appropriate potential applied to the print agent in the print agent source. The charged resin component, by virtue of an appropriate potential on the electrostatic image areas, is attracted to the latent electrostatic image on the PIP. The print agent does not adhere to the charged, non-image areas and forms an image on the surface of the latent electrostatic image. The photoconductor will thereby acquire a developed print agent electrostatic ink composition pattern on its surface.

The pattern may then be transferred to an intermediate (or image) transfer member, by virtue of an appropriate potential applied between the photoconductor and the intermediate transfer member such that the charged print agent is attracted to the intermediate transfer member. The print agent pattern may then be dried and fused on the intermediate transfer member before being transferred to the print media sheet (for example, adhering to the colder surface thereof). In some examples, the intermediate transfer member is heated. In another example, the print apparatus 410 may be a print apparatus of a different type.

Such print apparatus is capable of producing prints at high speed and in some examples, a sample print may be periodically selected for defect analysis. In carrying out the methods described above, the sample print periodicity may be altered, such that sample prints are scanned more often, as the fault detection is based on a plurality of printed sheets. In some examples, each sheet may be scanned. In some examples, an analysis may be carried out after around 50 sheets have been scanned. The number of sheets which are combined to identify linear defects may be determined empirically, for example to provide a threshold detection rate without excessive use of processing resources.

Figure 5:
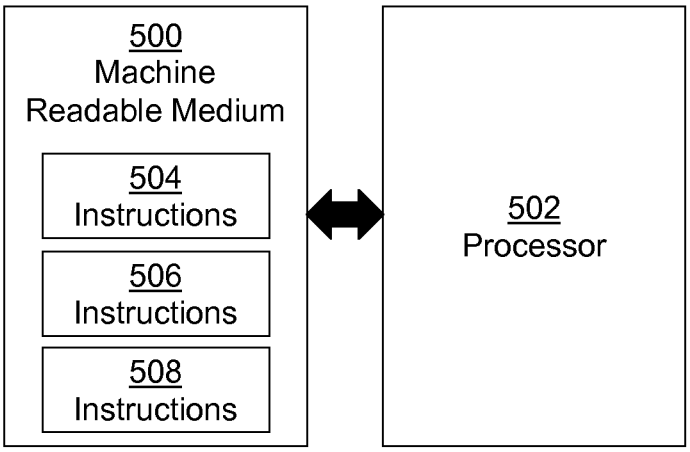
FIG. 5 is an example of a machine readable medium in association with a processor.

FIG. 5 is an example of a tangible (non-transitory) machine readable medium 500 in association with a processor 502. The machine readable medium 500 comprises instructions 504 which, when executed by the processor 502, cause the processor 502 to determine an accumulated one dimensional projection of data indicative of defects detected across each of a plurality of printed substrate sheets. The machine readable medium 500 further comprises instructions 506 which, when executed by the processor 502 to compare the accumulated one dimensional projection to a threshold (for example, as described above in relation to FIG. 2, in particular in forming the graph 210). The machine readable medium 500 further comprises instructions 508 which, when executed by the processor 502 to, where the accumulated one dimensional projection exceeds a threshold, generate an indication of the presence of a linear defect. As noted above, a 2D indication of defects (a 'defect map', which may be a stacked accumulation of a plurality of defect maps) may be projected into a 1D point to give a one dimensional defect output, which may be compared to a threshold. The projection may for example be a projection in a direction parallel to an edge of the substrate sheet. Generating the indication may comprise generating any form of an alert, for example changing the display of a screen, sounding an alarm, or the like. In some examples, the indication may comprise an indication of a remedial action, for example, indicate that servicing or replacement of an intermediate transfer member within a print apparatus is advisable. In some examples, the instructions may cause the processor 502 interrupt a print run.

The instructions 504, 506, 508 may be instructions to cause the processor 502 to determine an accumulated one dimensional projection of combined data indicative of defects detected across each of a plurality of printed substrate sheets, as discussed above in relation to FIG. 2. Moreover, as also discussed in relation to FIG. 2, the instructions 504, 506, 508 may be to cause the processor 502 to generate an indication of the presence of a linear defect based on at least one of the location of the defect on the substrate sheet and the width of the defect.

Aspects of some examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least one flow in the flow charts, as well as combinations of the flows in the flow charts can be realized by machine readable instructions.

The machine readable instructions may, for example, be executed by a general purpose computer, a special purpose computer, an embedded processor or processors of other programmable data processing devices to realize the functions described in the description and diagrams, and which may for example comprises at least part of the processing circuitry 404, the image analyser 406 or the defect categorising module 408. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims and/or any of the other dependent claim(s).

The invention claimed is:

1. A method comprising:

determining, by a processor, a cumulative indication of defects present in a linear sub-portion located in a common position of each substrate sheet of a plurality of successive substrate sheets bearing a printed image, including determining, for each substrate sheet of the successive substrate sheets, a defect map indicative of locations of defects within each substrate sheet, and generating a value indicative of a summation of defects in a corresponding linear sub-portion by combining indications of the locations of defects from the defect map for each substrate sheet of the successive substrate sheets; and identifying, by the processor, a linear defect within the printed image of each substrate sheet of the successive substrate sheets based on the cumulative indication of defects exceeding a threshold.

2. A method according to claim 1 further comprising:

acquiring, at the processor, a plurality of scanned images, each comprising a scanned image of a respective substrate sheet of the successive substrate sheets bearing the printed image; and analyzing a linear sub-portion located in a common position in each scanned image to identify defects therein;

wherein determining the cumulative indication of defects comprises:

determining a value indicative of a printing deficiency at each of a plurality of locations of each substrate sheet of the successive substrate sheets; and combining the values associated with a location of the linear sub-portion of each substrate sheet of the successive substrate sheets.

3. A method as claimed in claim 1, wherein identifying the linear defect comprises comparing the cumulative indication of defects to the threshold, and the method further comprises generating, by the processor, an alert indicative of the linear defect based on the cumulative indication of defects exceeding the threshold in the comparison.

4. A method as claimed in claim 1 further comprising selecting, by the processor, a linear sub-portion to analyze, wherein the selecting comprises selecting a linear sub-portion located in a common position of each substrate sheet of the successive substrate sheets having an orientation which is parallel to an edge of a respective substrate sheet.

5. A method as claimed in claim 1, further comprising selecting, by the processor, a linear sub-portion to analyze, wherein the selecting comprises selecting a linear sub-portion located in a common position of each substrate sheet of the successive substrate sheets which is within a predetermined sub-region of a respective substrate sheet.

6. A method as claimed in claim 5, further comprising determining the predetermined sub-region based on dimensions of a previously printed substrate sheet.

7. A method as claimed in claim 1, further comprising determining a maximum in a plurality of combined accumulated defect values and, based on the linear sub-portion providing said maximum, identifying a location of the linear defect as being within the linear sub-portion.

8. A method as claimed in claim 1 comprising identifying, by the processor, a deficiency in an image receiving surface based on at least one of:

the presence of the linear defect;

a position of the linear defect on the printed substrate sheet; and a width of a region of the printed substrate sheet comprising the linear defect.

9. A method as claimed in claim 1, wherein determining the cumulative indication of defects comprises producing a plurality of defect maps each indicating two-dimensional locations of defects in a respective substrate sheet, and deriving a one-dimensional defect output by projecting the two-dimensional locations of defects into a one-dimensional point.

10. A method as claimed in claim 1, wherein a width of the linear sub-portion is based on a resolution of a print apparatus used to print the printed image.

11. An apparatus comprising:

a scanning apparatus to scan a plurality of successive prints; and processing circuitry comprising:

an image analyzer to identify defects in the scans of the successive prints; and a defect categorizing module to accumulate an indication of any defects in each of a plurality of corresponding linear sub-portions of the successive prints and categorize a defect based on the defect being within a linear sub-portion of a predetermined region of each of the successive prints, the image analyzer to determine, for each of the successive prints, a defect map indicative of locations of defects within each of the successive prints, the defect categorizing module to combine indications of the locations of defects from the defect map for each of the successive prints to generate a value indicative of a summation of defects in the corresponding linear sub-portions, and the corresponding linear sub-portions each being in a same position of each of the successive prints.

12. An apparatus according to claim 11 in which the defect categorizing module is to categorize a defect as an image transfer member defect when the value exceeds a threshold.

13. An apparatus as claimed in claim 11, further comprising a print apparatus to print the successive prints.

14. An apparatus according to claim 11 in which a width of the linear sub-portions is based on a resolution of the scanning apparatus.

15. An apparatus according to claim 13 in which a width of the linear sub-portions is based on a resolution of the print apparatus.

16. A tangible machine readable medium comprising instructions which, when executed by a processor, cause the processor to:

determine an accumulated one dimensional projection of data indicative of defects detected in a linear sub-portion located in a same position of each of a plurality of printed substrate sheets, including produce a plurality of defect maps each including two dimensional locations of defects in a respective one of the plurality of printed substrate sheets, the two dimensional locations representing the data indicative of defects;

compare the accumulated one dimensional projection to a threshold; and where the accumulated one dimensional projection of data indicative of defects detected in the linear sub-portion of successive substrate sheets of the plurality of printed substrate sheets exceeds a threshold, generate an indication of a presence of a linear defect.

17. A tangible machine readable medium according to claim 16, wherein the instructions to cause the processor to determine an accumulated one dimensional projection comprise instructions to combine data indicative of defects detected in the linear sub-portion of the successive substrate sheets and to generate a one dimensional projection of the combined data.

18. A tangible machine readable medium according to claim 16, wherein the instructions to cause the processor to generate an indication of the presence of a linear defect comprise instructions to determine an indication of the presence of the linear defect based on at least one of a location of the linear defect on the successive substrate sheets and a width of the linear defect.

* * * * *